US006283133B1

(12) United States Patent
Furuta et al.

(10) Patent No.: US 6,283,133 B1
(45) Date of Patent: Sep. 4, 2001

(54) METHOD FOR CLEANING HEAVY HYDROCARBON SCALE ADHERED TO HEAT EXCHANGER AND PIPING STRUCTURE FOR CLEANING

(75) Inventors: Akio Furuta; Masatoshi Yamada; Yuji Itoh, all of Handa; Satoshi Endoh; Takashi Saitoh, both of Yokohama, all of (JP)

(73) Assignees: JGC Corporation; Mitsubishi Rayon Co., Ltd., both of Tokyo (JP)

( * ) Notice: Subject to any disclaimer, the term of this patent is extended or adjusted under 35 U.S.C. 154(b) by 0 days.

(21) Appl. No.: 09/129,443

(22) Filed: Jul. 30, 1998

(30) Foreign Application Priority Data

Aug. 18, 1997 (JP) ..... 9-221801
Feb. 27, 1998 (JP) ..... 10-048301

(51) Int. Cl.[7] ..... B08B 9/02; C23G 5/024; C23G 5/032

(52) U.S. Cl. ..... 134/22.14; 134/22.1; 134/22.12; 134/22.18; 134/22.19

(58) Field of Search ..... 134/22.1, 22.12, 134/22.14, 22.18, 22.19, 111, 169 R, 98.1

(56) References Cited

U.S. PATENT DOCUMENTS 2,059,231 * 11/1936 Hamilton ..... 134/169 R
2,741,596 * 4/1956 Luark et al. ..... 134/22.14
4,032,360 6/1977 Sharp ..... 134/3
4,108,681 8/1978 Lawson et al. ..... 134/20
4,474,622 * 10/1984 Foster ..... 134/10
5,425,814 6/1995 Krajicek et al. ..... 134/22.1

FOREIGN PATENT DOCUMENTS 0 629 671 A2 12/1994 (EP) .
9-118993 5/1997 (JP) .
9-159393 6/1997 (JP) .

* cited by examiner

*Primary Examiner*—Randy Gulakowski
*Assistant Examiner*—Saeed Chaudhry
(74) *Attorney, Agent, or Firm*—Darby & Darby

(57) ABSTRACT

The present invention relates to a method for cleaning heavy hydrocarbon scale from a shell and tube heat exchanger or other such equipment incorporated in a device in a petroleum refining plant or the like that processes petroleum hydrocarbons as a raw material. A mixture of petroleum-derived hydrocarbon A which can dissolve the oil component of the heavy hydrocarbon scale and an oxygen-containing polar organic compound B that promotes dissolution and dispersion is employed as the organic cleaning solvent. As a result, the heavy hydrocarbon scale can be removed with surety within a short period of time at low cost.

15 Claims, 9 Drawing Sheets

METHOD FOR CLEANING HEAVY HYDROCARBON SCALE ADHERED TO HEAT EXCHANGER AND PIPING STRUCTURE FOR CLEANING

BACKGROUND OF THE INVENTION

1. Field of the Invention

The present invention relates to a method for cleaning heavy hydrocarbon scale from a shell and tube heat exchanger or other such device incorporated in a equipment in a petroleum refining plant or the like that processes petroleum hydrocarbons as a raw material. The present invention also relates to a piping structure for cleaning the device employed in the aforementioned cleaning method.

The present specification is based on patent applications filed in Japan (Japanese Patent Application No. Hei09-221801, Japanese Patent Application No. Hei10-48301), the content of which is incorporated herein by reference.

2. Description of the Related Art

Highly viscous heavy hydrocarbon-derived foulant (hereinafter, referred to as "scale") containing iron sulfide, catalyst and the like adheres on tubes and the like inside heat exchangers or other devices incorporated into coking, fluid catalytic cracker, or atmospheric or vacuum distillation units which process heavy hydrocarbon-derived raw material in a petroleum refining plant or the like. Scale adhesions on these types of equipment reduce the efficiency of heat transfer and have a negative impact on the overall production efficiency of the plant. As a result, the plant must be shut down regularly for a given period of time in order to clean the equipment.

Cleaning of such equipment has conventionally been carried out using a mechanical cleaning method in which foulant is physically removed, or a chemical cleaning method in which the foulant is chemically removed.

Various mechanical cleaning methods are available, such as a jet cleaning method in which high pressure water is continuously sprayed though a small diameter nozzle, so that the force of the water removes the scale; a blast cleaning method in which an abrasive such as sand, alumina, or steel balls is sprayed at high speed, so that the force of impact removes the scale; a pig cleaning method in which pig is compression relayed by means of air or water inside piping to remove the scale; and a cutting cleaning method in which scale is removed by rotating a cutter or brush.

In the case of chemical cleaning methods, a method is available in which scale is dissolved and removed using chemicals which mainly contain surface active agents.

However, when cleaning heavy hydrocarbon scale, considerable time and expense was incurred in order to remove the highly viscous scale, regardless of which of the aforementioned mechanical cleaning methods was employed. For example, water-jet cleaning was carried out to remove foulant from the inner and outer surfaces of tubes of heat exchanger between the residual oil and the crude oil in the petroleum refining plant's atmospheric distillation unit or a vacuum distillation unit. Water jet cleaning was performed when operations in the plant were suspended for overall servicing, or by suspending operation of only a portion of the equipment and disassembling it during plant operations. Equipment disassembling is the operation of extracting the fluid inside a piece of equipment, removing the shell cover, and pulling out the tube bundle.

Disposing the equipment after disassembling and cleaning it requires large equipment. Moreover, much care must be exercised when inserting the tube bundle. It is also necessary to confirm that flammable substances are below a specific concentration during equipment disassembling. As a result, this operation required much time and expense.

Further, this operation was also problematic in that it presented a danger to workers during movement of heavy equipment, cleaning operations, treatment of waste water, and high pressure jet operations. Also, the plant's operational efficiency fell because of the requirement to suspend operations in a long period of time when disassembling the equipment.

In general, chemical cleaning methods have not been sufficiently effective in dissolving and removing heavy hydrocarbon scale. For this reason, when employing conventional chemicals, it was necessary to maintain the temperature at 80° C. during the cleaning process in order to increase the efficiency of scale removal.

However, aqueous cleaning solvents using conventional chemicals presented an environmental hazard by a treatment of the waste cleaning solvent. For this reason, it was necessary to treat the waste cleaning solvent without the environmental hazard, adding to the costs of the procedure. Moreover, the chemical products themselves were expensive, so that overall costs rose.

In order to resolve the problem of the time required for the cleaning operation, U.S. patent application No. 5,425,814 discloses a cleaning technique for hydrocarbon processing equipment, for example. The technique leaves out a pre-cleaning operation, referred to as "steam out", in which steam is sent inside the system to remove volatile components, especially benzene, to a level below the operational standard. Cleaning time is significantly shortened as a result. Stable cleaning is maintained in this technique by compounding, circulating an aqueous solution comprising of terpenes and surface active agents conventionally employed inside the system, and employing a filter in the circulating loop. However, the technique's efficacy in removing heavy hydrocarbon scale adhered to equipment in a plant employing petroleum-derived hydrocarbon raw material remains problematic.

In particular, in recent years, the duration between regular maintenance has lengthened, requiring cleaning of heat exchangers and the like before the next maintenance period. In this case, plant operations are not suspended, but rather the throughput is reduced and the equipment to be cleaned is isolated from the line. Alternatively, operation of a portion of the devices is halted, and OSM (on-steam maintenance) is performed. However, it is desirable to make the cleaning time as short as possible so that productivity is not reduced

SUMMARY OF THE INVENTION

It is the object of the present invention to provide a method for cleaning heavy hydrocarbon scale adhered to equipment in which the operational time for removing the scale is short, there is no risk during the operation, treatment of the waste cleaning solvent is not problematic, and the scale is removed easily and with surety at low cost. It is an additional objective of the present invention to provide a piping structure for cleaning which is used with the method.

Accordingly, in the method of the present invention, an organic cleaning solvent is employed to clean equipment having heavy hydrocarbon scale adhesions, the equipment incorporated into a device for processing petroleum-derived hydrocarbons, wherein the organic cleaning solvent is a mixture comprising of a petroleum-derived hydrocarbon A which can dissolve the oil component of the heavy hydrocarbon scale and an oxygen-containing polar organic compound B that promotes dissolution and dispersion as active components, the method comprising:

a dissolving/dispersing step in which oil foulant is dissolved and dispersed by supplying and circulating an organic cleaning solvent inside the device or by soaking the equipment in the organic cleaning solvent;

a removal by peeling step carried out at the same time as or subsequent to the dissolving/dispersing step in which the remaining sludge from the heavy hydrocarbon scale is removed by peeling; and a mixing and processing step in which the used organic cleaning solvent is mixed in with the raw material and processed.

It is desirable to provide a step for forming a circulating line prior to the dissolving/dispersing step by connecting the means for supplying and circulating the cleaning solvent to the equipment to be cleaned, with cycling cleaning preferably carried out in a closed system.

The following effects are obtained as a result of the present invention's approach to resolving the aforementioned problems.

Namely, when cleaning such petroleum refining plant equipment as heat exchangers incorporated into coking, fluid catalytic cracker, or atmospheric or vacuum distillation units to which heavy hydrocarbon scale has adhered, the heavy hydrocarbon scale is removed without dangerous operations, in a short period of time with surety and at low cost.

Further, since the duration of suspension of plant operations during cleaning is reduced or eliminated, the cleaning operation causes only a slight decrease in the plant's operational efficiency.

Thus, the operating efficiency of the heat exchanger or the like is improved, while the operational costs associated with cleaning are reduced.

Moreover, the waste cleaning solvent can be processed inside the petroleum refining facility, so that costs associated with this process are not incurred and environmental contamination need not be a concern.

The current applicability of a technique such as described above, enabling equipment having scale adhesions to be cleaned in a short period of time with good efficiency, has been highly anticipated in view of the growing practice of operating a petroleum refining plant continuously for an extended period of time. Of course this technique is also effective in shortening the duration of regular maintenance operations.

DESCRIPTION OF THE PREFERRED EMBODIMENTS

Figure 1:
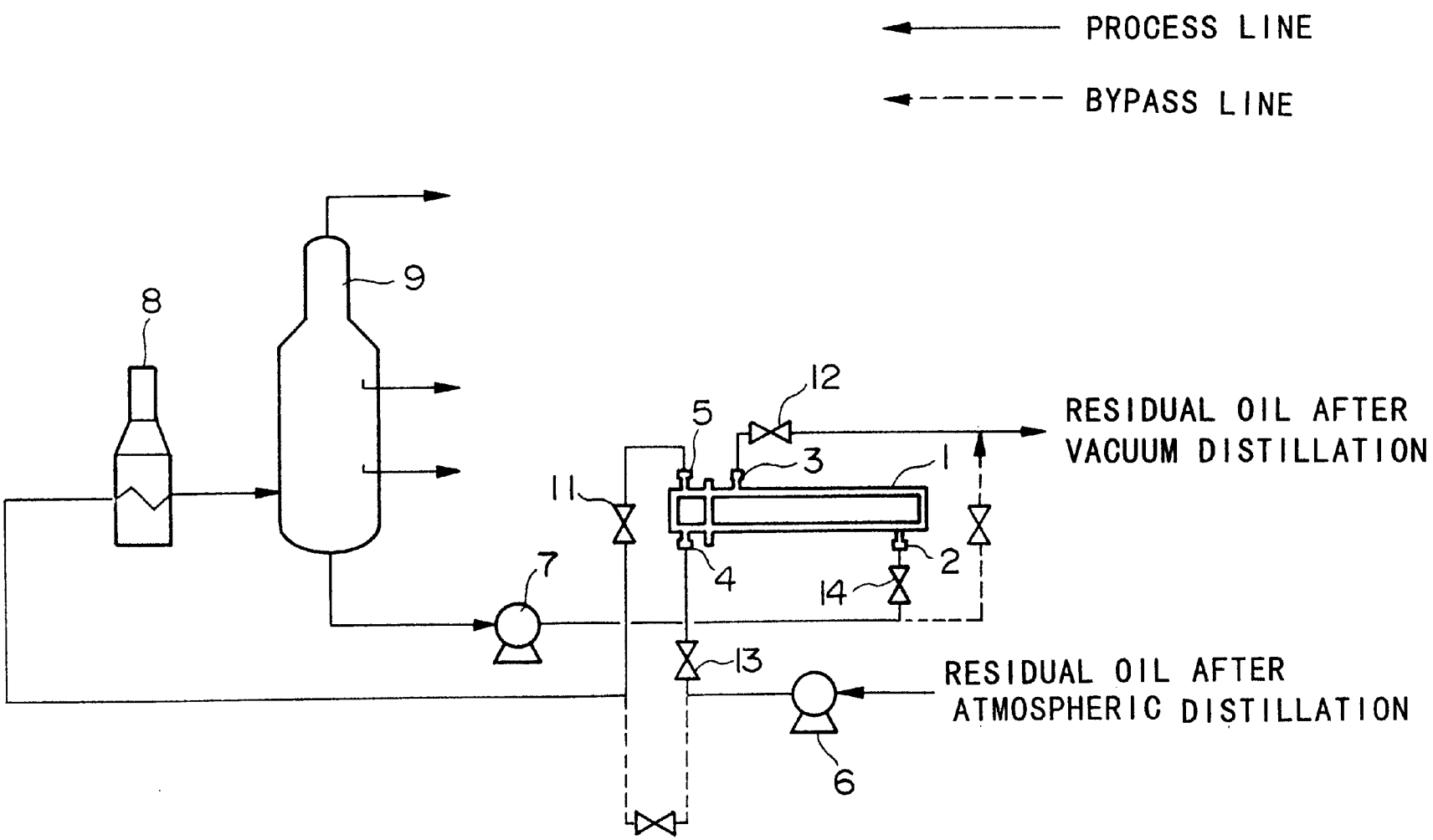
FIG. 1 is a schematic structural diagram showing the process line at the bottom of the petroleum refining plant's vacuum distillation unit, and an example of a bypass line in the present invention for isolating the device to be cleaned from the process line.

The present inventors discovered that a mixture of a petroleum-derived hydrocarbon A and an oxygen-containing polar organic compound B is extremely effective in removing heavy hydrocarbon scale in particular. Thereafter, the present inventors conceived of a highly efficacious cleaning method using this organic cleaning solvent, and a piping structure for cleaning equipment employing this cleaning method.

Heavy hydrocarbon scale adhered to tubes or the like inside equipment such as a shell and tube heat exchanger consists of a highly viscous oil component and sludge (particulate components) like iron sulfide and so on. The scale affixes to the surface of the tube due to the adhesive strength of the oil component.

The petroleum-derived hydrocarbon A which is one of the active components of the present invention's organic cleaning solvent functions to dissolve the highly viscous oil foulant in the scale. The oxygen-containing polar organic compound B which is the other active component of the present invention's organic cleaning solvent serves to facilitate the penetration of petroleum-derived hydrocarbon A into the scale.

Due to the cooperative function of components A and B, the oil component not only on the surface of the scale, but also inside the scale, is dissolved and dispersed in the organic cleaning solvent in the dissolving/dispersing step of the present invention's cleaning method. As a result, the highly viscous scale is changed to a solid particulate matter (sludge).

Then, during the step of removing the scale by peeling, the solid particulate sludge remaining after the scale has been changed to a solid particulate matter can be removed easily from the surface of the equipment.

Even if the oxygen-containing polar organic compound B is returned to the raw material being processed, and become mixed in and treated as a raw material, they have no undesirable effect on the petroleum refining plant's processes, such as, for example, by effecting a catalyst or the like. The petroleum-derived hydrocarbon A also does not present a problem since it is supplied from inside the petroleum refining facility.

Accordingly, an organic cleaning solvent comprising petroleum-derived hydrocarbon A and oxygen-containing polar organic compound B does not require a separate process to treat the used cleaning solvent. Rather, the organic cleaning solvent can be processed by feeding it back into the refining facility. As a result, costs associated with treating the used cleaning solvent are not incurred. Moreover, since petroleum-derived hydrocarbon A can be recovered from the mixture, environmental contamination is not a concern.

Further, it is even more preferable to provide a step for forming a circulating line prior to the dissolving/dispersing step by connecting the means which supplies and circulates the cleaning solvent to the equipment to be cleaned. By carrying out circulating cleaning in a close system in this manner, the dissolving/dispersing step and the removal by peeling step can be carried out at the same time.

During the dissolving/dispersing step and the removal by peeling step, highly viscous scale is changed and the sludge (solid particulate matter) only resides due to the cooperative action of the two components in the organic cleaning solvent. The organic cleaning solvent circulates within the equipment at a fixed linear velocity, so that the scale sludge which is in the form of a solid particulate is removed from the surface of the equipment by the physical force of the liquid, and conveyed outside the equipment. Thus, the time required for cleaning is significantly reduced.

The structure of the present invention will now be explained in detail.

The organic cleaning solvent employed in the present invention is a mixture comprising of a petroleum-derived hydrocarbon A, which dissolves the oil foulant in a heavy hydrocarbon scale, and an oxygen-containing polar organic compound, which promotes the dissolution and dispersion of the scale in petroleum-derived hydrocarbon A as active components.

Compounds applicable as petroleum-derived hydrocarbon A are not particularly restricted, provided that the compound employed is a hydrocarbon which dissolves the oil foulant in a heavy hydrocarbon scale, with examples ranging from low boiling point compounds like gasoline and naptha to high boiling point compounds like fuel oil. Of these, the raw material, intermediate product, or final product of a device processing petroleum-derived hydrocarbons as a raw material is desirable from the perspective of ease of handling and acquisition. A compound obtained by refining crude oil which has a boiling point of 200° C. or higher and is a liquid at ordinary temperature is preferred.

Specifically, available compounds include the residual oil after atmospheric distillation in a petroleum refining device; light gas oil (denoted as "LGO" hereinafter) which is the light oil fraction obtained by fractionation; heavy gas oil (denoted as "HGO" hereinafter), which is the light oil fraction from a vacuum distillation unit; light cycle oil (denoted as "LCO" hereinafter); as well as compound monomers included in the preceding such as paraffin-derived hydrocarbons like dodecane, tridecane, tetradecane, and pentadecane; decahydroalkylnaphthalenes like decahydromethylnaphthalene, decahydrotrimethylnaphthalene, decahydroethylnaphthalene, decahydrodiethylnaphthalene, decahydro-n-propylnaphthalene, and decahydro-isopropylnaphthalene; non-aromatic cyclic hydrocarbons like butylmethylcyclohexane, methylpentylcyclohexane, heptylcyclohexane, diethylcyclohexane, aromatic hydrocarbons like and tetralin; and.

These may be employed alone or in a mixture, in view of the ability to dissolve the heavy hydrocarbon scale to be cleaned.

Oxygen-containing polar organic compound B is preferably at least one compound selected from the group comprising aromatic ketones, aliphatic ketones, and carbonic acid esters represented by the following general formula (I) which promotes dissolution and dispersion of oil foulant in petroleum-derived hydrocarbon A and which is mutually soluble with petroleum-derived hydrocarbon A.

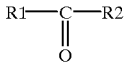

(I)

[Wherein, R1 and R2 each represent one group selected from among 1–8C alkyl groups (including substituted alkyl groups), alkylene groups (including substituted alkylene groups), alkoxy groups (including substituted alkoxy groups), alkyleneoxy groups (including substituted alkyleneoxy groups), and phenyl groups (including substituted phenyl groups).

Each of the substituted groups represents at least one group selected from 1–4C straight or branched chain alkyl groups, alkylene groups, alkoxy groups, hydroxyl groups, phenoxy groups and phenyl groups.]

Specific examples of the carbonic acid ester include methyl α-methyoxyisobutyrate, methyl β-methyoxy isobutyrate (hereinafter, abbreviated as MBM), methyl α-hydroxyisobutyrate, ethyl α-hydroxyisobutyrate, 3-methyl-3-methoxybutyl acetate, 3-methoxybutyl acetate, ethyleneglycol monoacetate, ethyleneglycol diacetate, ethyleneglycol monomethyl ether acetate, ethyleneglycol monoethyl ether acetate, ethyleneglycol monopropyl ether acetate, ethyleneglycol monobutyl ether acetate, propyleneglycol monoacetate, propyleneglycol diacetate, proplyeneglycol monomethyl ether acetate, propyleneglycol ethyl ether acetate, propyleneglycol monopropyl ether acetate, propyleneglycol monobutyl ether acetate, dipropyleneglycol monoacetate, dipropyleneglycol diacetate, dipropyleneglycol monomethyl ether acetate, dipropyleneglycol monoethyl ether acetate, dipropyleneglycol monobutyl ether acetate, propyleneglycol monomethyl ether propeonate, diethyleneglycol monomethyl ether acetate, diethyleneglycol monoethyl ether acetate, diethyleneglycol monobutyl ether acetate, ethyl 3-ethoxypropionate, methyl 3-methoxypropionate, ethyl lactate, butyl lactate, dimethyl succinate, dimethyl glutarate, dimethyl adipate, isobutyl formate, butyl acetate, ethyl propionate, ethyl benzoate, and the like.

Examples of applicable aliphatic ketones include acetone, methyl ethyl ketone, methyl propyl ketone, isopropyl methyl ketone, isobutyl methyl keton, pinacolone, diethyl ketone, diisopropyl ketone, methyl n-amyl ketone, methyl iso-amyl ketone, cyclohexanone, and the like.

Examples of applicable aromatic ketones include acetophenone, propiophenone, butylphenone, valerophenone, benzophenone and the like.

These compounds may be use alone or in combinations of two or more.

MBM and acetophenone are optimal from among these due to their high efficacy in dissolving the oil component of the scale. Accordingly, it is preferable to use these alone or as a mixture.

The A:B mixing ratio for petroleum-derived hydrocarbon A and oxygen-containing polar organic compound B is preferably in the range of 100:1~2:3, and even more preferably, 100:1~1:1.

When the proportion of petroleum-derived hydrocarbon A exceeds the above-cited range, petroleum-derived hydrocarbon A penetrates the heavy hydrocarbon scale more slowly, so that the scale is dissolved at a slower rate. Accordingly, this is inconvenient since the time required to clean the equipment is extended.

When the proportion of oxygen-containing polar organic compound B exceeds the aforementioned range, the amount of scale removed is reduced and higher costs are incurred. Moreover, when the proportion of oxygen-containing polar organic compound B is below this range, the scale cannot be removed.

Organic solvents other than oxygen-containing polar organic compound B may be added to the aforementioned organic cleaning solvent cited above. In the case where other foulant in addition to the heavy hydrocarbon scale is present, then this organic solvent is preferably able to dissolve and disperse such foulant.

Specific examples of organic solvents include various ethers such as propyl ether, phenyl ethyl ether, phenyl ether, benzyl ether, ethyleneglycol dimethylether, propyleneglycol dimethyl ether, and propyleneglycol diethyl ether; alcohols such as propanol, butanol, octhanol, 3-methoxybutanol, 3-methyl-3-methoxylbutanol, and propyleneglycol; and glycol ethers such as propyleneglycol monomethyl ether, dipropyleneglycol monomethyl ether, ethyleneglycol monobenzyl ether, diethyleneglycol monobenzyl ether, propyleneglycol monobenzyl ether, dipropyleneglycol monobenzyl ether, and the like.

The cleaning method of the present invention will now be explained in detail using two preferred embodiments thereof.

In the first embodiment, cleaning is carried out through: (1) a dissolving/dispersing step, (2) a removal by peeling step, and (3) a mixing and processing treatment step.

Embodiment 1

(1) Dissolving/dispersing Step

The first step is a dissolving/dispersing step in which scale adhered to the equipment is removed by dissolving.

First, operations in the petroleum refining plant are suspended, and the heat exchanger or other piece of equipment incorporated in the atmospheric distillation, vacuum distillation, fluid catalytic cracker or coking unit is isolated from the plant system. The aforementioned organic cleaning solvent is supplied inside the tubes or between the tubes and the shell of the equipment being cleaned. A pump or the like is employed to circulate the organic cleaning solvent, so that good contact is achieved between the scale and the organic cleaning solvent. Alternatively, the heat exchanger's tube bundle is withdrawn, the components to which the scale is adhered are soaked in the organic cleaning solvent, and agitated by bubbling, etc.

By maintaining contact between the scale and the organic cleaning solvent for a specific period of time, for example 10 hours at ordinary temperature (20° C.) by one of these methods, almost all of the oil component in the heavy hydrocarbon scale adhered on the equipment surface can be dissolved and dispersed in the organic cleaning solvent. Any scale not dissolved and dispersed which remains as sludge is changed to a solid particulate matter which can easily be peeled off from the surface.

(2) Removal by Peeling

The second step is a removal by peeling step in which the sludge is physically removed.

This step employs a mechanical cleaning method typically used. From among these, Jet cleaning is optimally employed because removal of the sludge is easily accomplished in a short period of time.

Because removal by peeling proceeds via the dissolving/dispersing step described above, the energy required for cleaning is considerably reduced and the operation is carried out under low pressure conditions as compared to a cleaning method employing conventional mechanical cleaning only. Moreover, since the sludge can be removed in a short period of time, the risk and cost of the operation can be reduced.

(3) Mixing and Processing

The third step is a mixing and processing step in which the used organic cleaning solvent, which contains heavy oil from the scale which was dissolved and dispersed in the dissolving/dispersing step, is returned to and mixed with the raw material.

This used cleaning solvent can be mixed with the raw material inside the petroleum refining unit. Further, this mixture can be processed in the plant by the usual distillation unit. Thus, no special process is required to treat the used cleaning solvent, so that additional costs are not incurred and there is no risk of environmental pollution.

While the series of steps for cleaning in the first embodiment can be carried out at the temperature which is higher than the melting point of the organic cleaning solvent, the higher the temperature of the first step of dissolving/dispersing, the more rapidly the oil component of the scale can be dissolved, so that the time required for the cleaning process can be reduced.

The lower temperature limit for the process is ordinary temperature, preferably 20° C. The upper temperature limit for the process is 300° C., preferably 260° C., and even more preferably 200° C. At temperatures above 300° C., the components of the organic cleaning solvent may break down depending on the type of organic cleaning solvent employed. Accordingly, this is not desirable as it may pose a danger.

In the cleaning method according to the first embodiment, a dissolving/dispersing step is carried out using the aforementioned organic cleaning solvent, and sludge is removed in the removal by peeling step. When the dissolving/dispersing step is carried out at ordinary temperature, the cleaning process can be accomplished in an extremely short time. As a result, the operational costs and risks are reduced as compared to a conventional chemical cleaning method.

The temperature for the dissolving/dispersing step may be optimally selected in view of operational costs and overall time for the process.

The second embodiment of the present invention will now be explained in detail.

The method for cleaning equipment to which heavy hydrocarbon scale is adhered is carried out via (1) a circulating line assembling step, (2) a dissolving/dispersing step and a removal by peeling step, and (3) a mixing and processing step.

Embodiment 2

(1) Circulating Line Assembling Step

The first step of assembling a circulating line is a preparatory step carried out after isolating the equipment to be cleaned from the process line by interrupting the piping connected thereto, in which the remaining fluid in the equipment is drained out, and an organic cleaning solvent circulating supply means is connected to the equipment to assemble a circulating line for the organic cleaning solvent. It is preferable that this circulating line be a closed system.

FIG. 1 shows an example of the process line (feed oil flow) at the bottom of a vacuum distillation tower in the petroleum refining plant. In the figure, numeral 1 indicates a heat exchanger. Heat exchanger 1 is connected to a heating furnace 8 and a vacuum distillation tower 9. The solid-line arrow indicates the ordinary direction of flow of the process line.

Although only one heat exchanger 1 is shown in the figure, a plurality of heat exchangers 1 may be disposed in parallel or series in a typical oil refining plant.

When a plurality of heat exchangers 1 are disposed in parallel, the piping before and after the heat exchanger to be cleaned may be closed off to isolate the heat exchanger from the process line. When a plurality of heat exchangers 1 are disposed in series, a bypass line is provided for detouring the heat exchanger to be cleaned, after which the heat exchanger is isolated from the process line by closing off the piping before and after as in the case of heat exchangers provided in parallel.

The inside of heat exchanger 1 is divided into tube and shell members (not shown). A number of metallic tubes are aligned inside the shell. Heat exchange is carried out by flushing different fluids inside the tube and inside the shell (outside the tube).

FIG. 1 shows that residual oil after atmospheric distillation is supplied into the tube from tube supply opening 4. This residual oil after atmospheric distillation passes through the tube, and is discharged out through tube discharge opening 5. The residual oil after atmospheric distillation then passes through heating furnace 8, is introduced into vacuum distillation tower 9, and is separated by being distilled into various components. Residual oil after atmospheric distillation from vacuum distillation tower 9 (vacuum residual oil) is supplied from shell supply opening 2 on the shell side of heat exchanger 1. This vacuum residual oil passes through the shell, and is discharged from shell discharge opening 3.

When executing the present invention in a heat exchanger 1 of this type, heat exchanger 1 is first isolated from the process line.

For example, as shown by the dashed arrow in FIG. 1, valves 11 and 13 are closed to bypass the piping before and after heat exchanger 1, i.e., to bypass supply opening 4 and exhaust opening 5 on the tube side of heat exchanger 1, and valves 12 and 14 are closed to bypass supply opening 2 and exhaust opening 3 on the shell side of heat exchanger 1. As a result, the heat exchanger 1 which is to be cleaned is isolated from the process line.

The remaining fluid inside the equipment is drained out after the heat exchanger 1 to be cleaned is isolated from the process line.

Next, a cleaning solvent circulating supply means is connected to the aforementioned equipment, to form a circulating line.

Because cleaning can be carried out by isolating the equipment to be cleaned from the processing line and assembling a circulating line in this way, it is not necessary to suspend the oil refining process line. Moreover, when a plurality of heat exchangers 1 are provided, cleaning can be carried out by isolating each device one at a time from the process line. Thus, this does not have a large effect on plant operations. Also, since cleaning can be easily carried out, the time required for each step is reduced as compared to conventional methods in which the process line had to be stopped for a long period of time.

The cleaning solvent circulating supply means has at least a filter, scale sedimentation tank, circulating pump for circulating the organic cleaning solvent inside the equipment and a cleaning solvent tank for supplying the aforementioned organic cleaning solvent, and is provided with valves and piping for connecting to the heat exchanger, etc.

Figure 2:
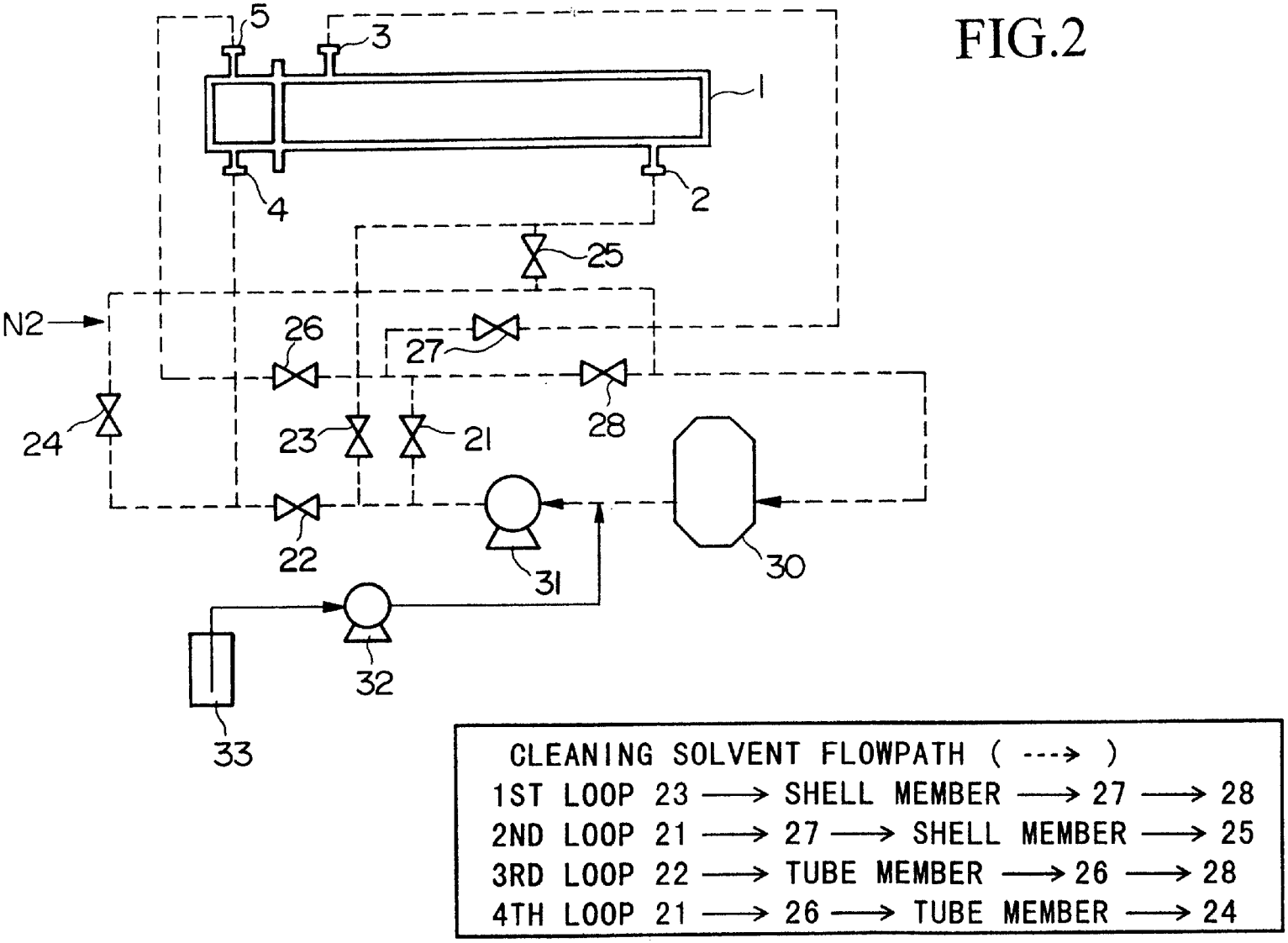
FIG. 2 is a schematic structural diagram showing one example of the piping structure for the circulating line in the present invention.

FIG. 2 shows an example of a circulating line which is for connecting to a piece of equipment to be cleaned when that equipment is not provided with a connecting member for connecting to the cleaning circulating supply means. Note, however, that the circulating line is not limited thereto.

The cleaning solvent circulating supply means has a circulating pump 31 for circulating the aforementioned organic cleaning solvent; a cleaning solvent tank 33 for supplying the organic cleaning solvent; and a cleaning solvent pump 32 for supplying the organic cleaning solvent. The cleaning solvent circulating supply means is provided with piping connections on the tube and shell sides thereof, and valves 21–28 for adjusting the direction of flow of the organic cleaning solvent inside the various piping. A sedimenting column 30 is also provided. The organic cleaning solvent that has passed through heat exchanger 1 flows into sedimenting column 30, and the peeled off scale in the organic cleaning solvent sediments therein.

The piping of the cleaning solvent circulating supply means is connected to a tube supply opening 4, tube discharge opening 5, shell supply opening 2, and shell exhaust opening 3 of heat exchanger 1, as shown in FIG. 2.

Four loops through which the organic cleaning solvent flows are formed in the circulating line shown in FIG. 2. The loops can be selected by opening and closing the various valves.

The first loop is for circulating organic cleaning solvent through the shell side of heat exchanger 1 in the same direction as the usual flow of the process fluid in the process line (i.e., from the shell supply opening 2 to the shell discharge opening 3).

This first loop is formed by opening valves 23, 27, and 28, and closing all the other valves.

The second loop is for circulating organic cleaning solvent through the shell side of heat exchanger 1 in a direction opposite the usual direction of flow of the process fluid in the process line (i.e., from shell discharge opening 3 to shell supply opening 2).

The second loop is formed by opening valves 21, 27, and 25, and closing all other valves.

The third loop is for circulating organic cleaning solvent through the tube side of heat exchanger 1 in the same direction as the usual direction of flow of the process fluid in the process line (i.e., from tube supply opening 4 to tube discharge opening 5).

The third loop is formed by opening valves 22, 26, and 28, and closing all other valves.

The fourth loop is for circulating organic cleaning solvent through the tube side of heat exchanger 1 in a direction opposite the usual direction of flow of the process fluid in the process line (i.e., from tube discharge opening 5 to tube supply opening 4).

The fourth loop is formed by opening valves 21, 26, and 24, and closing all the other valves.

Thus, by selecting each of the loops formed in this way, and circulating a supply of organic cleaning solvent through the respective loops, it is possible to clean the inside of the shell and tube members in heat exchanger 1.

A circulating line can easily be formed by connecting such a cleaning solvent circulating supply means, enabling cleaning using the organic cleaning solvents cited above.

Figure 3:
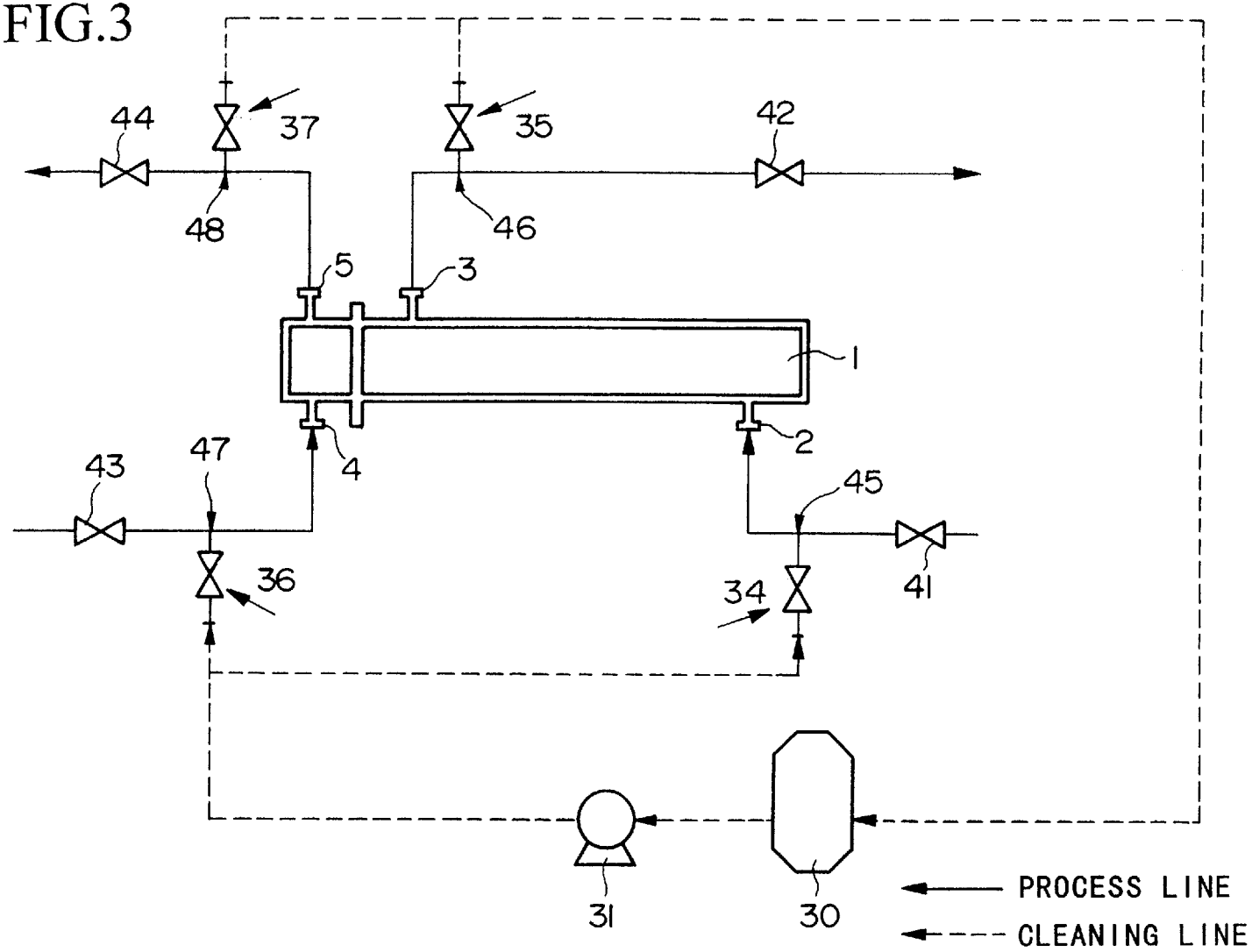
FIG. 3 is a schematic structural diagram showing one example of the piping structure for the connecting member for the cleaning solvent in the equipment to be cleaned.

FIG. 3 shows an example of the formation of a circulating line to an arrangement in which a connecting nozzle for the cleaning solvent has been provided in advance to heat exchanger 1.

By providing the equipment to be cleaned with a connecting member for the cleaning solvent in advance, the time required for the connecting operation can be reduced.

Namely, the equipment to be cleaned can be easily isolated from the process line, and the circulating line readily formed. Thus, the time for the process can be greatly reduced, and the operational time even further shortened.

In the case where a connecting nozzle for the cleaning solvent is provided to the equipment in this way, a valve for interrupting the process fluid is provided to the piping which supplies the process fluid to the equipment. Branched piping is provided closer to the equipment side than the valve, the branched piping provided with a flange for connecting to the cleaning solvent circulating supply means and a valve for supplying, discharging or stopping the organic cleaning solvent. A valve for interrupting the process fluid is provided in the same manner to the piping for discharging the equipment's process fluid. Branched piping is provided on the equipment side, and is provided with a flange for connecting to the cleaning solvent circulating supply means and a valve for supplying, discharging or stopping the organic cleaning solvent.

In the case of heat exchanger 1 shown in FIG. 3, valves 41, 42, 43, and 44 are provided to the process line piping which links shell supply opening 2, shell discharge opening 3, tube supply opening 4, and tube discharge opening 5, respectively. Branched piping 34, 35, 36, and 37, which are equipped with a valve and flange for connecting to the cleaning solvent circulating supply means, are provided to a part of the piping that is closer to heat exchanger 1 than valves 41, 42, 43, and 44.

When connecting a cleaning solvent circulating supply means to a device having this kind of piping structure, the flanges of branched piping 34, 35, 36, and 37 can be opened and the piping of the cleaning solvent circulating supply means attached thereto.

The diameter of the opening of branched piping 34, 35, 36, and 37 is preferably 40% or more of that of the opening of the piping for the process fluid. The diameter of piping which is typically employed in a process line is on the order of 10 inches. Thus, a diameter of 4 inches or greater, and preferably in the range of 4~8 inches is desirable for the diameter of branched piping 34, 35, 36 and 37. The flow speed of the organic cleaning solvent is easily adjusted in a piping having a diameter in this range.

By closing valves 41, 42, 43 and 44, heat exchanger 1 can be isolated from the process line to form a closed line for cleaning. By opening valves 41, 42, 43, and 44, heat exchanger 1 can be returned to the process line.

An arrangement in which a plurality of heat exchangers 1 having this type of connecting nozzles are aligned in parallel or series, can be isolated from the process line by the opening or closing of valves as described above. Further, formation of a circulating line can be carried out smoothly by connecting the cleaning solvent circulating supply means at branched piping 34, 35, 36 and 37, and the time required for removing scale can be greatly reduced.

(2) Dissolving/dispersing Step, Removal by Peeling Step

In the second step, after forming a circulating line inside the equipment, organic cleaning solvent is supplied to the circulating line from the cleaning solvent circulating supply means, to dissolve and disperse the oil foulant in the heavy hydrocarbon scale adhered inside the equipment, and the sludge thereof is removed by peeling. In other words, the dissolving/dispersing step and the removal by peeling step are carried out simultaneously.

This step is performed after forming a circulating line as shown in FIGS. 2 and 3, by using a circulating pump 31 to circulate the organic cleaning solvent in the circulating line.

The linear velocity when supplying and circulating the organic cleaning solvent into the equipment is preferably 60% or more of the linear velocity of the process fluid (actual value measured=~0.2 m/sec), and more preferably above the usual linear velocity of the process fluid.

When the linear velocity for circulating the organic cleaning solvent is less than 60% of the process fluid's linear velocity, it is difficult to peel the sludge adhered inside the equipment. As a result, the cleaning time is insufficient.

The temperature for supplying and circulating the organic cleaning solvent is not particularly limited, provided that it is above the melting point of the organic cleaning solvent. Specifically, the lower limit for the temperature is ordinary temperature, preferably 20° C., and even more preferably 50° C. The upper limit is 300° C., preferably 260° C., and even more preferably 200° C.

When the temperature is below 20° C., the organic cleaning solvent tends to have a decreased efficacy in dissolving the oil component of the scale, while when the temperature is in excess of 300° C., there is risk that the organic cleaning solvent may crack, depending on the type employed.

By switching the direction of circulation of the organic cleaning solvent inside the equipment to be the same or opposite the direction of flow of the process fluid, it is possible to improve the cleaning effect. Switching of the flow direction can be accomplished by switching valves on the circulating line as described above.

The circulating duration is on the order of 0.5~3 hours per heat exchanger.

In the second step of dissolving/dispersing and removal by peeling, the oil component of the scale is dissolved by the organic cleaning solvent and the sludge is peeled away and mixed into the organic cleaning solvent. Since the main component of this scale is iron sulfide, it has a high specific gravity. Sludge having a large particle size sediments in the sedimenting tank of the circulating line. It is preferable to provide a filter near the exit of the sedimenting tank for this reason. Provision of a filter ensures that separation of the sludge will proceed with good efficiency, even further improving the efficiency of cleaning.

In this second step, the organic cleaning solvent circulates through a closed-system circulating line and the scale is removed. As a result, volatile components do not leak out, so that the system is highly safe.

(3) Mixing and Processing Step

Step 3 is a mixing and processing step for mixing the organic cleaning solvent into the raw material after cleaning, and processing it.

The used cleaning solvent remaining after step 2 can be mixed into the raw material inside the petroleum refining unit. This mixture can be processed in the petroleum plant in a regular distillation unit for example. Namely, cleaning can be concluded by discharging the used cleaning solvent from the circulating line after the second step, and mixed it into the raw material. Thus, it is not necessary to employ a special processing device for treating the used cleaning solvent. Accordingly, no costs are incurred, and environmental contamination need not be a concern.

The cleaning method of the second embodiment employs the aforementioned organic cleaning solvent, and precedes via first, second and third steps as described above. As a result, this method demonstrates superior efficacy in removing heavy hydrocarbon derivatives.

Moreover, since cleaning is carried out by isolating only the equipment to be cleaned from the process line, a device disassembling operation is not required. Further, an operation requiring human labor, such as jet cleaning, is not needed. Accordingly, the operational time can be significantly reduced, the method is safe, and the costs associated with the cleaning operation can be cut sharply. Since equipment cleaning can be realized without suspending operation of the plant, the negative impact of cleaning on the petroleum refining plant's operational efficiency can be held to a minimal level.

A circulating line is easily assembled, and the operational time can be reduced even further, by providing a piping structure in advance to the equipment to be cleaned which can be connected to the cleaning solvent circulating supply means. Additionally, if a large truck is used to convey the cleaning solvent circulating supply means to the equipment to be cleaned which is inside the petroleum refining plant, then it can be simply connected to the cleaning machine, and cleaning can be performed.

Because the used cleaning solvent after cleaning has been completed is returned into the oil petroleum refining device, mixed in and processed, it is not necessary to provide a special device for processing this fluid. Thus, environmental contamination is not a concern, and additional costs for such a process are not incurred.

EXAMPLES

The present invention will now be explained in detail using examples.

Text Example 1

First, the organic cleaning solvent employed in the present invention was prepared for the example, and a different solvent was prepared as a comparative example.

EXAMPLE 1

LGO was employed as petroleum derived hydrocarbon A, and a mixture comprising MBM and acetophenone in a ratio of 2:1 was employed as the oxygen-containing polar organic compound B. The organic cleaning solvent (mixture of A and B) according to Example 1 was then formulated by mixing compounds A and B to achieve a A:B mixing ratio of 15:3.

EXAMPLE 2

LGO was employed as petroleum derived hydrocarbon A, and MBM was employed as the oxygen-containing polar organic compound B. The organic cleaning solvent according (mixture of A and B) to Example 2 was then formulated by mixing compounds A and B to achieve a A:B mixing ratio of 6:4.

EXAMPLE 3

LGO was employed as petroleum derived hydrocarbon A, and acetophenone was employed as the oxygen-containing polar organic compound B. The organic cleaning solvent (mixture of A and B) according to Example 3 was then formulated by mixing compounds A and B to achieve a A:B mixing ratio of 6:4.

Comparative Example 1

LGO (petroleum derived hydrocarbon A) was used alone as the solvent according to Comparative Example 1.

Comparative Example 2

MBM (compound B) was used alone as the solvent according to Comparative Example 2.

Comparative Example 3

Acetophenone (compound B) was used alone as the solvent according to Comparative Example 3.

Each of the solvents according to Examples 1~3 and Comparative Examples 1~3 was mixed with scale adhered to a portion of the tube in a shell and tube heat exchanger incorporated in a vacuum distillation unit in a 1:1 ratio. The mixture was then rotated at a rotation speed of 216 rpm and a temperature of 20° C. The relationship between the reduction in scale and the duration of rotation was measured.

The thickness of the scale prior to rotation was designated as $L_o$, while the thickness after rotation was indicated as L. $L/L_o$ was determined and defined as the reduction in scale quantity.

Figure 4:
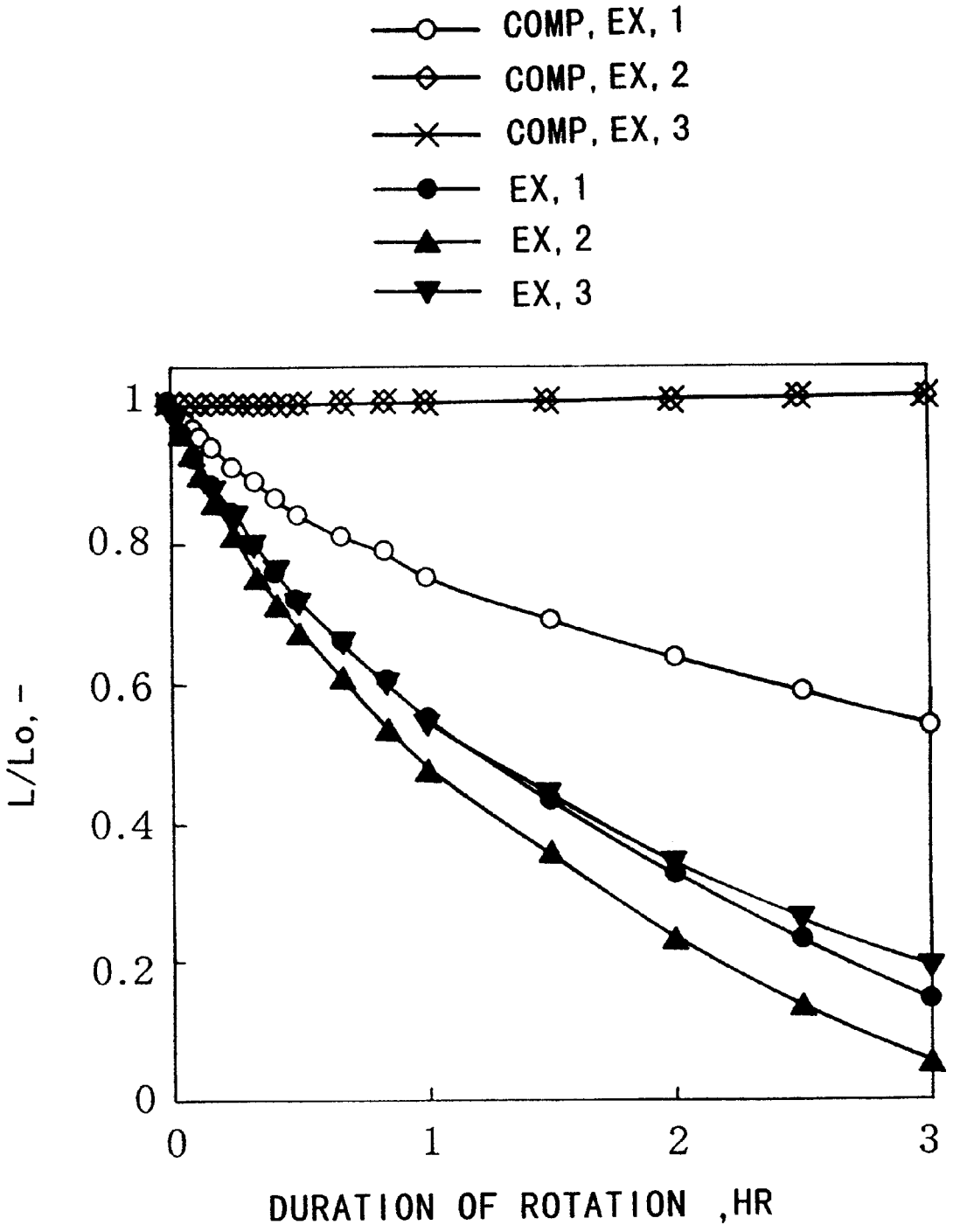
FIG. 4 is a graph showing the results of Test Example 1 in the present invention.

These results are shown on the graph in FIG. 4, in which the reduction in scale quantity $L/L_o$ is plotted along the vertical axis and the duration of rotation is plotted along the horizontal axis.

In the figures, the symbols ●, ▲, ▼, ○, ◇, and X indicate Example 1, Example 2, Example 3, Comparative Example 1, Comparative Example 2, and Comparative Example 3, respectively.

From the results of Test Example 1, it is clear that the compounds of Comparative Examples 2 and 3, i.e., the oxygen-containing polar organic compound B only, did not remove the heavy hydrocarbon scale at all. Further, although the compound of Comparative Example 1, i.e., petroleum derived hydrocarbon A (LGO) only, removed a portion of the scale, a longer period of time was required as compared to the examples. In contrast, the compounds of Examples 1~3 removed the scale quickly, and in a significant quantity.

Test Example 2

With the exception that LCO was employed instead of LGO, Test Example 2 was performed in the same manner as Test Example 1, to formulate solvents according to Examples 4~6 (corresponding to Examples 1~3) and Comparative Example 4 (corresponding to Comparative Example 1). The reduction in the amount of scale in each of these cases was measured in the same way as in Test Example 1.

Figure 5:
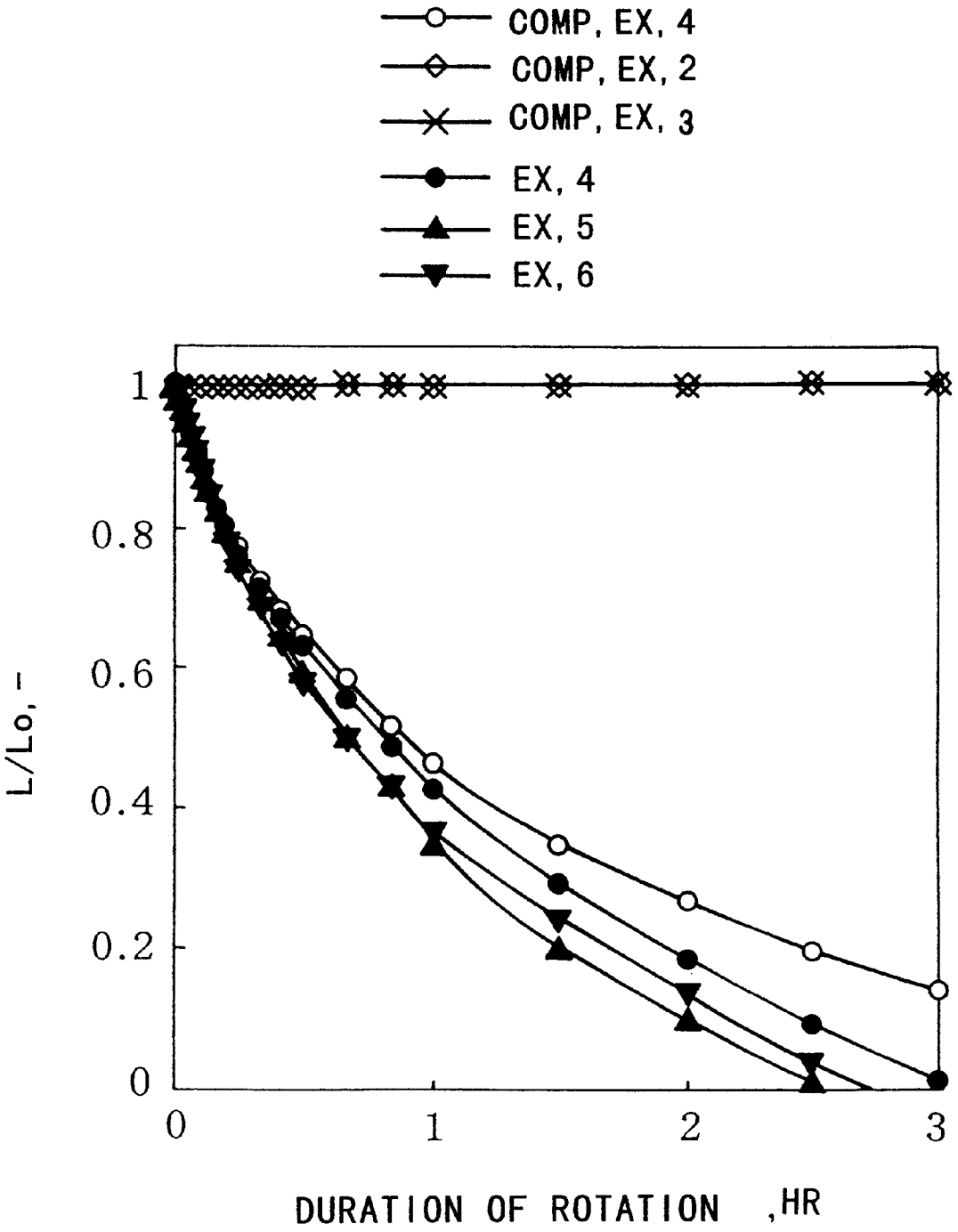
FIG. 5 is a graph showing the results of Test Example 2 in the present invention.

These results are shown in the graph in FIG. 5, with the reduction in scale quantity $L/L_o$ plotted on the vertical axis and the duration of rotation plotted along the horizontal axis.

In the figures, the symbols ●, ▲, ▼, ○, ◇, and X indicate Example 4, Example 5, Example 6, Comparative Example 4, Comparative Example 2, and Comparative Example 3, respectively.

From the results of Test Example 2, it may be seen that the compound of Comparative Example 4, i.e., petroleum derived hydrocarbon A (LCO) only, removed the scale more quickly than the compounds according to Comparative Examples 2 and 3. However, the scale was removed even more quickly by the compounds according to Examples 4~6, with the quantity thereof significantly reduced.

Test Example 3

LGO was employed as petroleum derived hydrocarbon A, and a mixture of MBM and acetophenone in a ratio of 1:2 was employed as the oxygen-containing polar organic compound B. Organic cleaning solvents were prepared by mixing compounds A and B together in an A:B mixing ratio of 1:0 (0%), 19:1 (5%), 9:1 (10%), 8:2 (20%), and 6:4 (40%), respectively. The percentages in the parenthesis indicate the proportion of oxygen-containing polar organic compound B contained in the organic cleaning solvent (where % is a vol %).

Scale composed of an equilibrium catalyst carried over from the fluid catalytic cracker and the oil at the bottom of the refining tower was employed for the test. This scale and the organic cleaning solvents formulated above were mixed in a 1:1 ratio, and rotated at a speed of 215 rpm and a temperature of 20° C. The relationship between the reduction in scale quantity $L/L_o$ and the duration of rotation was measured.

Figure 6:
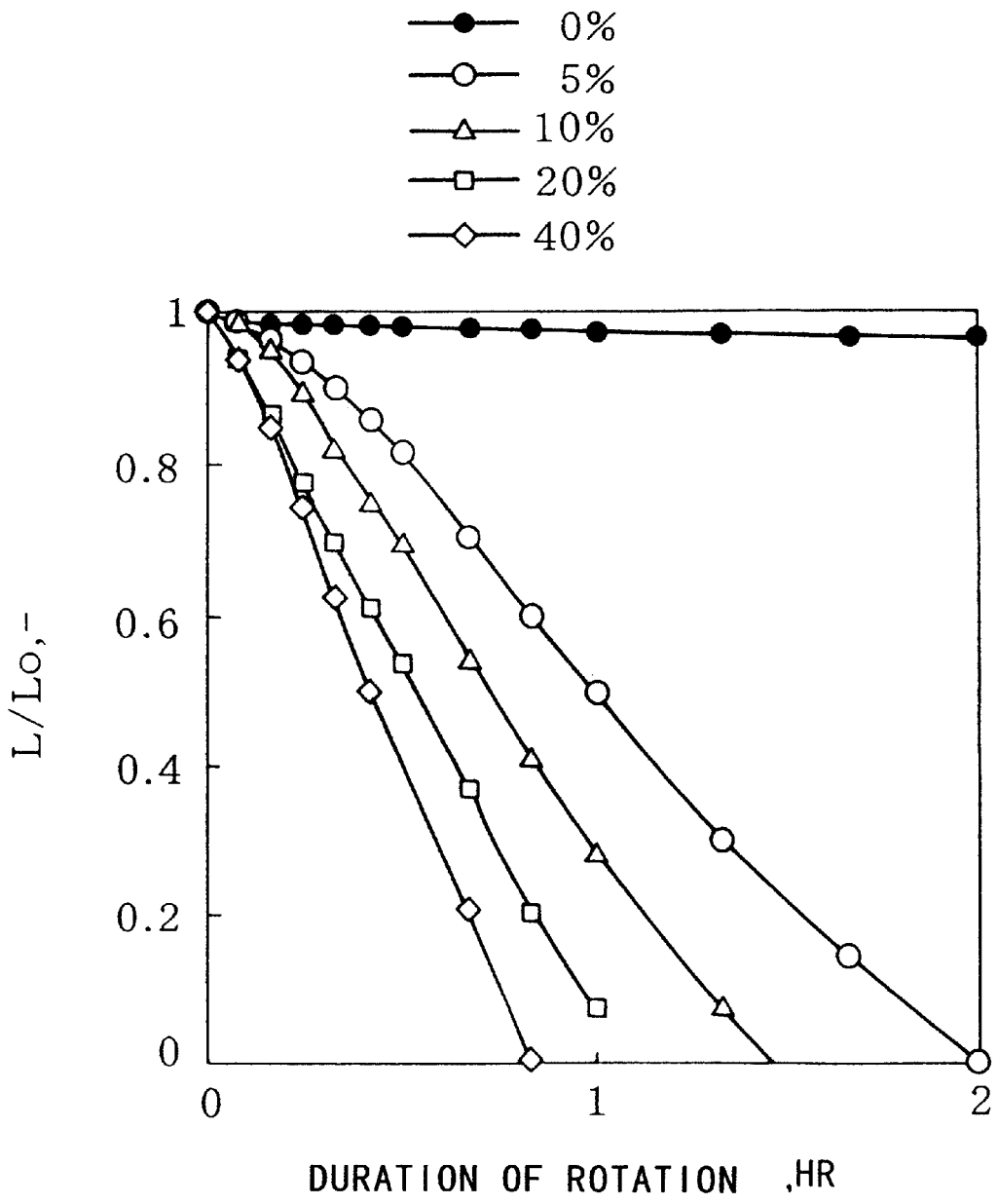
FIG. 6 is a graph showing the results of Test Example 3 in the present invention.

These results are shown on the graph in FIG. 6, in which the reduction in scale quantity $L/L_o$ is plotted along the vertical axis and the duration of rotation is plotted along the horizontal axis. In the figure, the proportion of oxygen-containing polar organic compound B in the organic cleaning solvent is indicated as a %. The symbols ●, ○, Δ, □, and ◇ indicate 0%, 5%, 10%, 20%, and 40%, respectively.

From the results of Test Example 3, it is clear that the organic cleaning solvent employed in the present invention's cleaning method (in the range of 5–40%) demonstrates sufficient cleaning efficacy.

Test Example 4

LGO was employed as petroleum derived hydrocarbon A, and acetophenone was employed as the oxygen-containing polar organic compound B. Organic cleaning solvents were formulated by varying the mixing ratio of the two compounds. The scale and the organic cleaning solvent were rotated under the same conditions as Test Example 1 and the reduction in the quantity of scale was measured. The reduction in the quantity of scale in this case was indicated as $(L_o-L)/L_o$.

Figure 7:
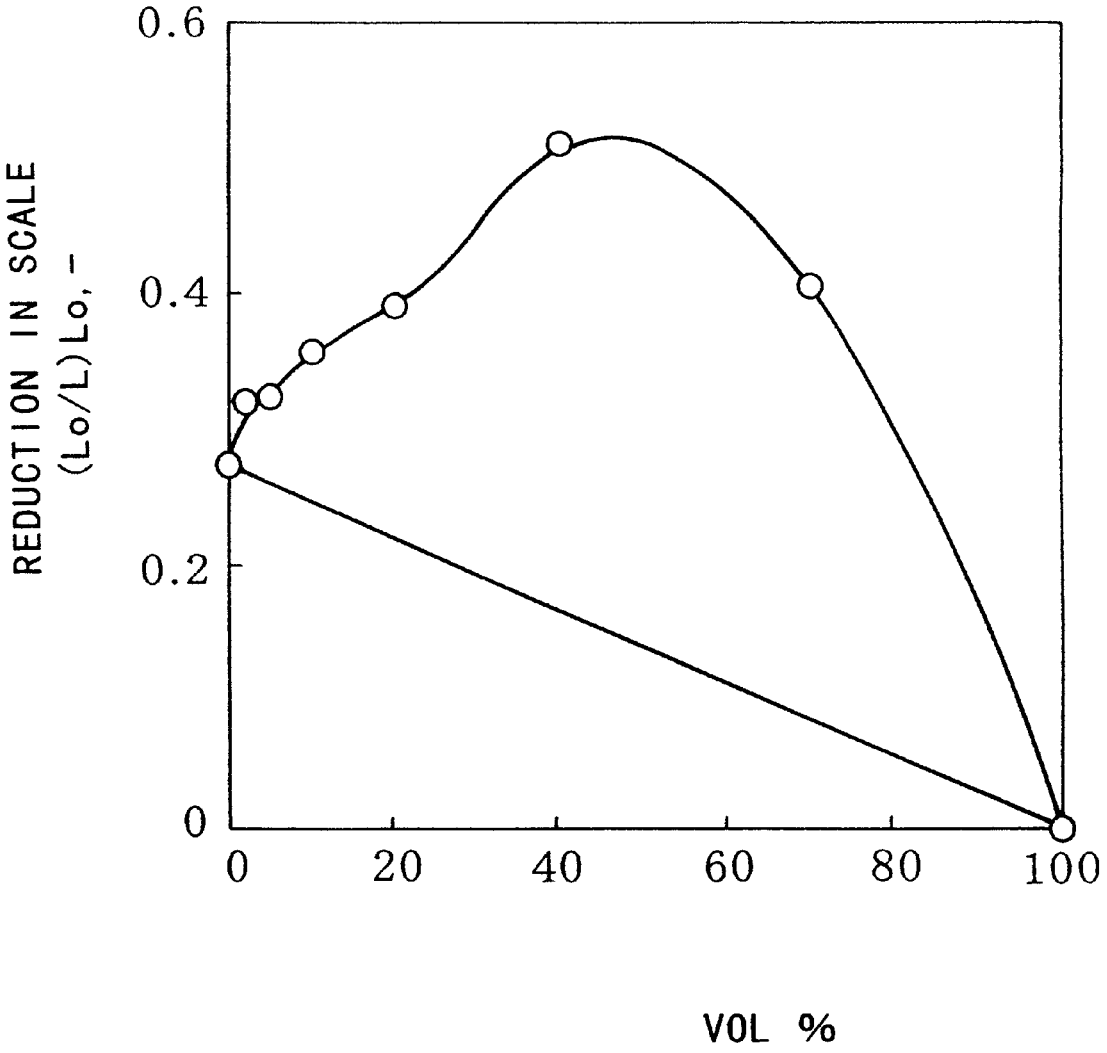
FIG. 7 is a graph showing the results of Test Example 4 in the present invention.

These results are shown in FIG. 7. The mixing ratio is indicated as the proportion of acetophenone in the organic cleaning solvent (acetophenone concentration). The reduction in the quantity of scale $(L_o-L)/L_o$ was plotted along the vertical axis, and the concentration of acetophenone (vol %) was plotted along the horizontal axis. The symbol ○ indicates the results of Test Example 4.

From the results of Test Example 4, it may be understood that when the proportion of acetophenone is above 1% (A:B mixing ratio of approximately 100:1), the amount of scale reduced is greater than when LGO alone is employed. Moreover, a maximal reduction in scale was achieved at a proportion of 40% (mixing ratio A:B is 6:4), so that this proportion is preferred. When the proportion of acetophenone exceeds 80% (A:B mixing ratio of 1:4), the reduction in the amount of scale is less than when LGO alone is used. Accordingly, adding acetophenone in excess of this level confers no advantage, but rather has a disadvantageous effect. Thus, the efficacy of adding even a small amount of acetophenone to LGO may be understood from the results as described above.

Test Example 5

Flow rate was reduced (from 24,000 BPSD to 12,000 BPSD) in the vacuum distillation unit.

A bypass was formed by closing the valves linking the process line to the tube and shell sides of a Feed/Bottom heat exchanger in a vacuum distillation unit, thereby isolating the heat exchanger from the process line. The fluid remaining inside the heat exchanger was discharged.

Next, the piping linking the supply and discharge members on the tube and shell sides of the heat exchanger were released, and the piping for the cleaning solvent circulating supply means was connected thereto, to form a circulating line. The piping structure employed for the circulating line was as shown in FIG. 2 (circulating line assembling step).

A mixture of light oil for petroleum-derived hydrocarbon A and MBM for oxygen-containing polar organic compound B in an A:B mixing ratio of 5:1 was employed for the organic cleaning solvent. This organic cleaning solvent for introduced into cleaning solvent tank 33 for the circulating line.

Next, the organic cleaning solvent was heated to 100° C., after which valves 23, 27, and 28 only were opened on the circulating line. The organic cleaning solvent was relayed from cleaning solvent tank 33 to the piping under the shell side of heat exchanger 1 by circulating pump 31. The flow volume of the organic cleaning solvent at this time was 120 kl/hr. Cleaning was performed by circulating the organic cleaning solvent for 4 hours. The linear velocity of the fluid in heat exchanger 1 was 0.4 m/sec. Part way through the cleaning process, switching of the valves was performed so that only valves 21, 27, and 25 were open. As a result, the circulating direction was reversed, so that the organic cleaning solvent was circulated from the piping above the shell side of the heat exchanger.

Next, the circulating line was switched by opening only valves 22, 26, and 28 on the tube side of the heat exchanger 1. The organic cleaning solvent was relayed from the piping under the tube side of heat exchanger 1, and cleaning was carried out by circulating the cleaning solvent for 3 hours in the same manner as performed on the shell side of heat exchanger 1. Again, part way through the cleaning process, the valves were switched, so that only valves 21, 26, and 24 were open. As a result, the direction of circulation was reversed, so that the organic cleaning solvent was circulated from the piping above the tube side of heat exchanger 1. (dissolve/disperse step, remove by peeling step)

Measurement revealed approximately 300 kg of an oil component dissolved in the waste fluid after completion of circulating cleaning. In addition, about 600 L of sludge was retrieved, of which 70% was iron sulfide.

After the cleaning process was completed, the cleaning solvent circulating supply means was drained out from heat exchanger 1, the valves linking the shell and tube sides of heat exchanger 1 to the process line were opened, and heat exchanger 1 was returned to the process line. Following the start of operation of heat exchanger 1, the equipment's total coefficient of heat transfer was found to have recovered to its initial value of 98%. Note that this value prior to cleaning had fallen to 60% of the initial value. In addition, following recovery, the tendency for the coefficient of heat transfer to deteriorate over time was as in the past.

In conventional cleaning methods employing equipment disassembling, equipment operations were suspended for 12 days in order to carry out cleaning. In contrast, the test examples only required 2 days.

Test Example 6

In order to secure the circulating line for heat exchanger 1 in Test Example 5, the supply and discharge piping for the process line on both the shell and tube sides of heat exchanger 1 were released, and the piping was directly connected to the piping of the cleaning solvent circulating supply means. As a result, time was required to remove heat insulating materials and the tracing steam line, adding about one day to the process.

Therefore, in Test Example 6, the design shown in FIG. 3 was employed for the process line piping on the shell and tube sides of heat exchanger 1, in which a valve and branched piping for connecting to the cleaning solvent circulating supply means is provided in advance. When connecting to the cleaning solvent circulating supply means, valves 41, 42, 43, and 44 were shut. The piping of the cleaning solvent circulating supply means was connected to branched piping 34, 35, 36, and 37 to form a circulating line. Heat exchanger 1 was then cleaned in the same manner as in Test Example 5, with superior results obtained. The time required for the cleaning process in Test Example 6 was one day.

Thus, by providing in advance an arrangement having a valve and branched piping for connecting to the cleaning solvent supply line, the time required for the process can be shortened.

Test Example 7

The cleaning efficacy of the present invention's heavy hydrocarbon scale cleaning method was investigated by forming material which simulated scale.

Figure 8:
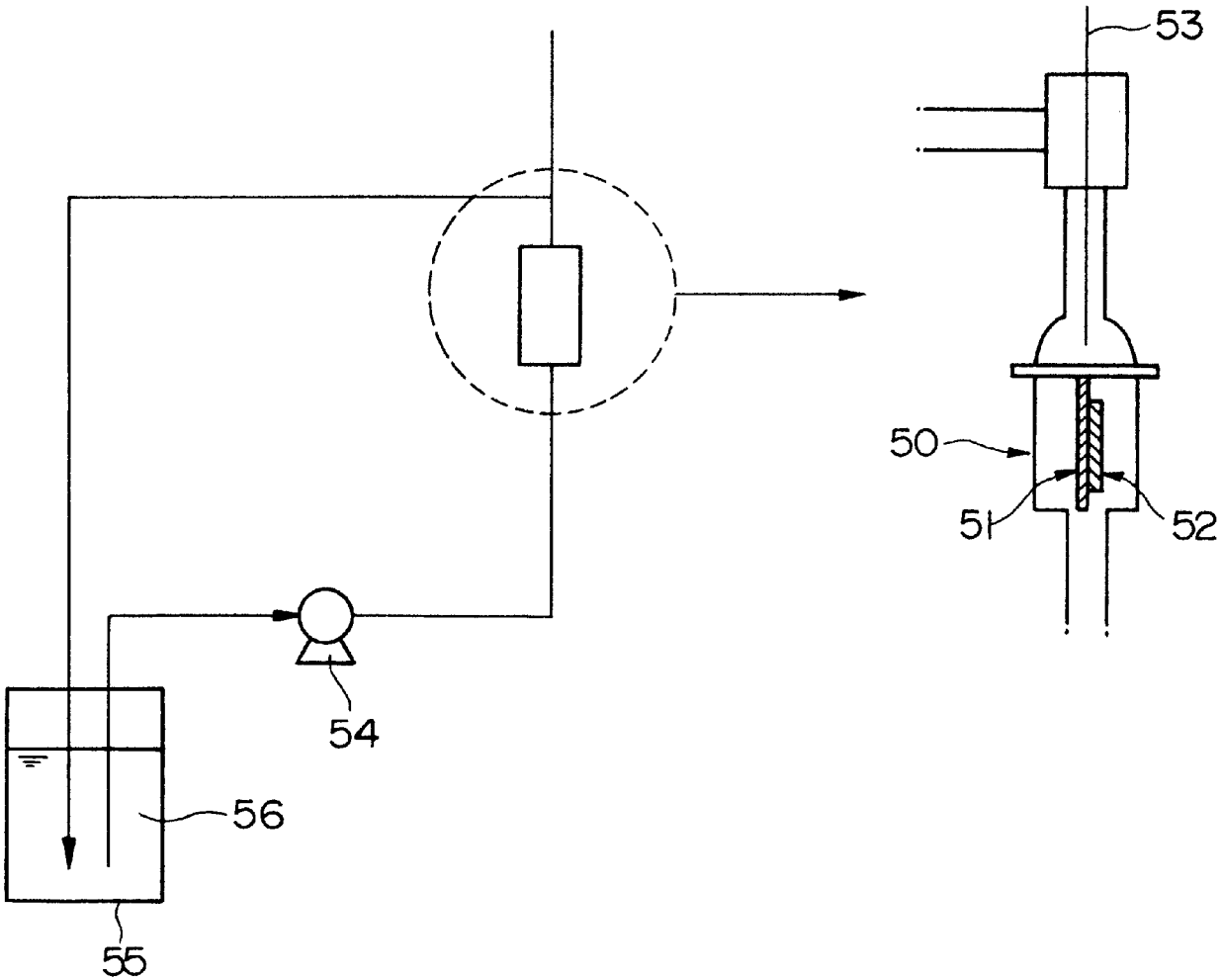
FIG. 8 is a schematic structural view showing the experimental equipment employed in Test Example 5.

FIG. 8 shows the device employed in this example.

First, the surface of a 10 mm ×20 mm carbon steel plate 51 was coated to a thickness of 5 mm with a foulant substance comprising 55% sludge containing mainly iron sulfide and 45% oil component collected from a heat exchanger in a vacuum distillation unit to form simulated scale 52. Next, carbon steel plate 51 having the adhered simulated scale 52 was disposed in a glass vessel 50 which had an internal diameter of 10 mm. Organic cleaning solvent 56 equivalent to that employed in Test Example 5 was placed in cleaning solvent tank 55. Circulating pump 54 was used to supply organic cleaning solvent 56 inside glass vessel 50 at a specific flow rate to bring it into contact with simulated scale 52. After one hour, the thickness ($t_1$) of simulated scale 52 was measured. From this value, the rate of decrease in the scale ($(5-t_1)/5$) was determined.

The flow volume of organic cleaning solvent 56 was adjusted so that the fluid linear velocity of organic cleaning solvent 56 inside glass vessel 50 was 0, 0.1, 0.2, 0.3, 0.4, 0.5, 0.6 m/sec. The thickness of simulated scale 52 and the rate of reduction in simulated scale 52 after cleaning was measured when the temperature inside glass vessel 50 was 25° C. and 50° C., respectively. These results are shown on the graph in FIG. 9.

Figure 9:
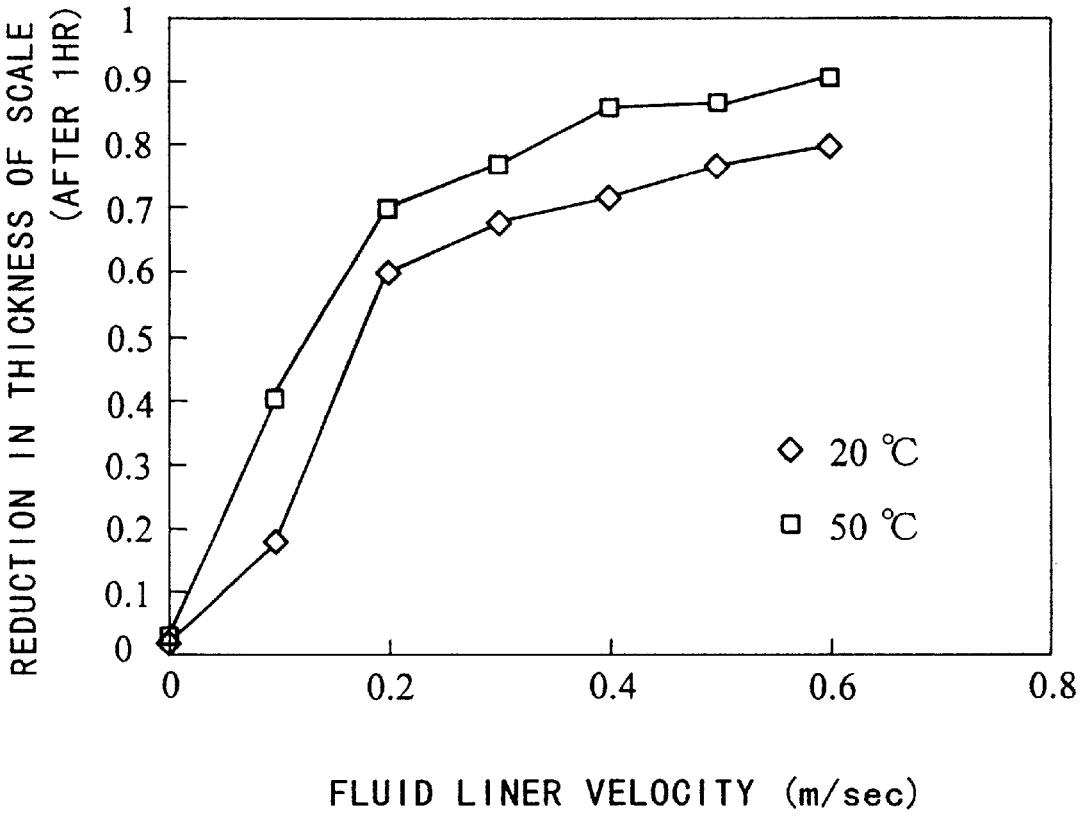
FIG. 9 is a graph showing the results of the measurements made in Test Example 5.

From the graph in FIG. 9, it may be understood that when the fluid linear velocity of the organic cleaning solvent was 0.1 m/sec or less, the rate of decrease of the scale in simulated scale 52 was low, and the simulated scale 52 could not be peeled from carbon steel surface 51. However, when the fluid linear velocity exceeded 0.2 m/sec, the cleaning efficacy was high, with a high rate of reduction in the scale achieved. Further, the higher the cleaning temperature, the higher the reduction in scale and the higher the efficacy of cleaning.

What is claimed:

1. A method for clearing an oil foulant of a heavy hydrocarbon scale adhering to a heat exchanger that is incorporated in a system which processes petroleum hydrocarbons as a raw material by using an organic solvent fluid wherein said heavy hydrocarbon scale contains an oil component and sludge, and said heat exchanger is disposed between a residual oil source and a crude oil source in an atmospheric distillation unit or a vacuum distillation unit of a petroleum refining plant, the method comprising:

a dissolving/dispersing step in which an organic cleaning solvent of a mixture comprised of a petroleum derived hydrocarbon A and an oxygen containing polar compound B as active components, and the petroleum derived hydrocarbon A has a boiling point of 200° C. or higher and is a liquid at ordinary temperature is supplied to and circulated inside the heat exchanger, or the heat exchanger is soaked in the organic cleaning solvent, to dissolve and disperse the oil foulant;

a removal by peeling step in which the remaining sludge from the heavy hydrocarbon scale is removed by peeling either concurrent with or after the dissolving/dispersing step; and a mixing and processing step in which the organic cleaning solvent is mixed into the raw material after cleaning, and processed.

2. A method for cleaning heavy hydrocarbon scale according to claim 1, wherein:

a circulating line assembling step is performed in which a circulating line is formed prior to the dissolving/dispersing step by isolating the heat exchanger to be cleaned from the process line by interrupting its connecting piping, draining fluid remaining in the equipment, and connecting a cleaning solvent circulating supply means to the equipment; and the dissolving/dispersing step and the removal by peeling step are carried out simultaneously by supplying and circulating organic cleaning solvent from the cleaning solvent circulating supply means inside the heat exchanger, dissolving and dispersing the oil foulant in the heavy hydrocarbon scale adhered inside the heat exchanger and removing the sludge thereof by peeling.

3. A method for cleaning heavy hydrocarbon scale according to claim 2, wherein in the circulating line assembling step, the heat exchanger to be cleaned is isolated from the process line without suspending plant operations, and connected to the cleaning solvent circulating supply means to form the circulating line.

4. A method for cleaning heavy hydrocarbon scale according to claim 2, wherein:

the cleaning solvent circulating supply means has a circulating pump for supplying the organic cleaning solvent, a sedimenting tank in which the peeled off sludge sediments, a filter for removing sludge and piping and valves for supplying, expelling or suspending flow of the organic cleaning solvent; and the direction and speed of flow of the organic cleaning solvent inside the heat exchanger to be cleaned can be adjusted.

5. A method for cleaning heavy hydrocarbon scale according to claim 2, wherein:

the cleaning equipment is provided with a valve for interrupting the process fluid on the piping which supplies the process fluid to the heat exchanger, and a branched piping that is provided closer to the heat exchanger side than the valve, the branched piping being provided with a flange for connecting to the cleaning solvent circulating supply means and a valve for supplying, discharging or suspending the organic cleaning solvent;

the cleaning equipment is provided with a piping structure provided with a valve for interrupting the process fluid that is provided in the same manner as to the piping for discharging the equipment's process fluid, and a branched piping provided on the heat exchanger side, the branched piping provided with a flange for connecting to the cleaning solvent circulating supply means and a valve for supplying, discharging or stopping the organic cleaning solvent; and a circulating line is formed by connecting the cleaning solvent circulating supply means to the heat exchanger to be cleaned.

6. A method for cleaning heavy hydrocarbon scale according to claim 5, wherein the diameter of the branched piping is 40% or more of the diameter of the piping for the process flow.

7. A method for cleaning heavy hydrocarbon scale according to claim 1, wherein the A:B mixing ratio for petroleum derived hydrocarbon A and oxygen containing polar organic compound B in the organic cleaning solvent is 100:1–2:3.

8. A method for cleaning heavy hydrocarbon scale according to claim 1, wherein petroleum derived hydrocarbon A can dissolve the oil foulant in heavy hydrocarbon scale, and is the raw material, intermediate product or final product of a device which processes petroleum hydrocarbon as a raw material.

9. A method for cleaning heavy hydrocarbon scale according to claim 1, wherein the oxygen-containing polar organic compound B is at least one compound selected from the group comprising aromatic ketone, aliphatic ketone, and carbonic acid esters represented by the following general formula which is mutually soluble with petroleum-derived hydrocarbon A:

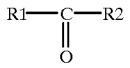

wherein, R1 and R2 each represent one group selected from among 1–8C alkyl groups (including substituted alkyl groups), alkylene groups (including substituted alkylene groups), alkoxy groups (including substituted alkoxy groups), alkyleneoxy groups (including substituted alkyleneoxy groups), and phenyl groups (including substituted phenyl groups).

10. A method for cleaning heavy hydrocarbon scale according to claim 1, wherein the dissolving/dispersing step is carried out at a temperature in the range of 20–300° C.

11. A method for cleaning heavy hydrocarbon scale according to claim 1, wherein the removal by peeling step is performed by a jet cleaning method.

12. A method for cleaning heavy hydrocarbon scale according to claim 1, wherein the linear velocity when the organic cleaning solvent is supplied and circulated inside the heat exchanger is 60% or more of the linear velocity of the process fluid.

13. A method for cleaning heavy hydrocarbon scale adhering to a heat exchanger according to claim 1, wherein the oxygen containing polar compound B is methyl β-methyoxy isobutyrate or acetophenone or a mixture thereof.

14. A method for clearing heavy hydrocarbon scale according to claim 13 wherein said petroleum derived hydrocarbon A comprises one or more of a residual oil after atmospheric distillation in a petroleum refining device, light gas oil which is a light oil function obtained by fractionation; heavy gas oil, which is the light oil fraction from a vacuum distillation unit, and light cycle oil.

15. A method for clearing heavy hydrocarbon scale according to claim 1 wherein said petroleum derived hydrocarbon A comprises one or more of a residual oil after atmospheric distillation in a petroleum refining device, light gas oil which is a light oil function obtained by fractionation; heavy gas oil, which is the light oil fraction from a vacuum distillation unit, and light cycle oil.

* * * * *